United States Patent [19]

Walkhoff

[11] Patent Number: 4,756,099

[45] Date of Patent: Jul. 12, 1988

[54] SKI BOOT

[75] Inventor: Klaus Walkhoff, Kreuzlingen, Switzerland

[73] Assignee: Raichle Sportschuh AG, Kreuzlingen, Switzerland

[21] Appl. No.: 9,800

[22] Filed: Feb. 2, 1987

[30] Foreign Application Priority Data

Jan. 31, 1986 [CH] Switzerland ..... 372/86
Jun. 12, 1986 [CH] Switzerland ..... 2388/86

[51] Int. Cl.[4] ..... A43B 5/04

[52] U.S. Cl. ..... 36/120; 36/54; 403/4

[58] Field of Search ..... 36/117–121, 36/54; 403/4

[56] References Cited

U.S. PATENT DOCUMENTS

| | | | |
|---|---|---|---|
| 4,106,876 | 8/1978 | Tregoning | 403/4 |
| 4,406,073 | 9/1983 | Spademan | 36/119 |
| 4,539,764 | 9/1985 | Pradier | 36/121 |
| 4,561,196 | 12/1985 | Petrini et al. | 36/118 |
| 4,615,128 | 10/1986 | Borsoi | 36/120 |

FOREIGN PATENT DOCUMENTS

| | | | |
|---|---|---|---|
| 0053340 | 6/1982 | European Pat. Off. | 36/120 |
| 0071055 | 2/1983 | European Pat. Off. . | |
| 0123636 | 10/1984 | European Pat. Off. | 36/120 |
| 2292442 | 6/1976 | France . | |
| 2570936 | 4/1986 | France | 36/117 |

*Primary Examiner*—James Kee Chi
*Attorney, Agent, or Firm*—Collard, Roe & Galgano

[57] ABSTRACT

A ski boot has a tongue part forwardly deflectable relative to the shank part connected to the sole of the boot, as the skier's lower legs move in the leaning forward direction. The deflectability of the tongue part can be limited by means of a limiting device consisting of laterally arranged limiting arrangements. By means of actuating elements, the limiting arrangements can be adjusted to different distances of deflection, permitting a more or less leaning forward stance depending on the needs of the skier. A ski boot with such a limiting device permits the skier to effortlessly adjust the degree of limitation in the leaning forward position in any desired way.

18 Claims, 5 Drawing Sheets

Fig. 3
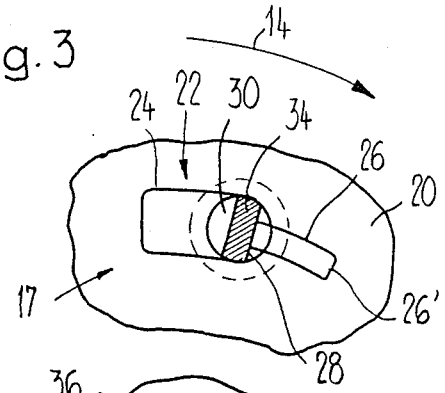
Fig. 4
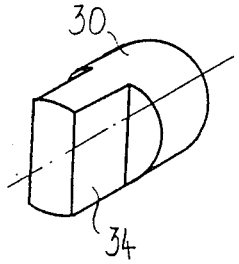
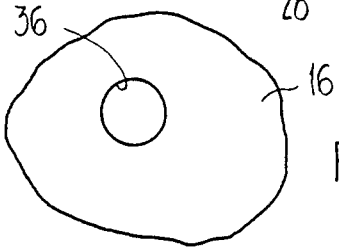
Fig. 5
Fig. 6
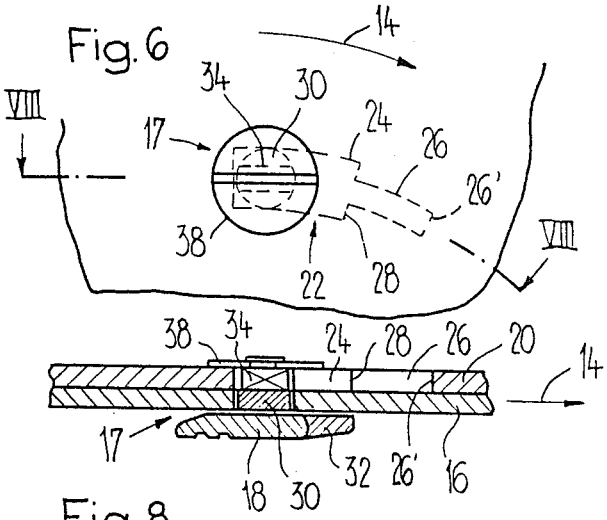
Fig. 8
Fig. 7
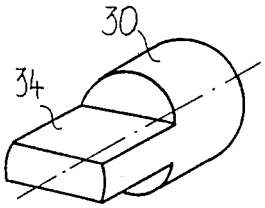

SKI BOOT

BACKGROUND OF THE INVENTION

This invention relates to a ski boot. More particularly, it relates to a ski boot having a tongue which is adjustably deflectable to permit the skier to lean forward while wearing the boot.

With ski boots of this type, the tongue is designed in such a way that it can be deflected relative to the stiff shell of the boot when loaded or stressed in the lengthwise direction of the boot such as when the skier leans forward. In the prior art, this deflection movement is facilitated by transversely extending ribs formed in the tongue (WO No. 81/00507). Such elastic deflectability of the tongue permits the skier to lean forward, that is to say, the thigh can move forward toward the tip of the boot. However, the yieldingness of the tongue depends upon its own construction, and cannot be adjusted to the skills and preference of the individual skier.

It is known, furthermore, to construct the front part of the shank of a ski boot in two parts, and to connect the two parts with each other via adjustment mechanisms (EP-OS No. 0071055). The position of the two parts relative to each other can be changed by means of such adjustment mechanisms so as to permit the boot to adapt to the anatomy of the lower leg of the person wearing the ski boot. After the two parts have been adjusted in their positions relative to each other, such parts remain fixed relative to each other, and are jointly swivelled in the direction of the tip of the boot when the skier assumes a leaning forward stance.

Accordingly, it is an object of the present invention is to provide a ski boot in which the degree of yieldingness of the tongue can be adjusted in a simple manner to provide a desired movement of the tongue when the skier leans forward, without changing the construction of the boot.

Another object of the invention is to provide a ski boot having means for selecting several different degrees of yieldingness of the tongue when the skier leans forward.

A still further object of the invention is to provide a ski boot having a device which the skier can adjust for the desired amount of deflection of the tongue when the skier leans forward, which adjustment can be made quickly and as required to meet particular circumstances.

SUMMARY OF THE INVENTION

Certain of the foregoing and related objects are readily achieved according to the invention by the provision of the improved ski boot of the type which includes a boot shell having a sole, a shank part, and a tongue which is deflectable relative to the boot shell in the lengthwise direction of the boot when under load or stress, such as when the skier leans forward. The invention is characterized by the provision of means for limiting the degree of deflection of the tongue which means includes at least one stop means.

Other objects and features of the present invention will become apparent from the following detailed description considered in connection with the accompanying drawings. It is to be understood, however, that the drawings are designed for the purpose of illustration only and not as a definition of the limits of the invention.

BRIEF DESCRIPTION OF THE DRAWINGS

In the drawings, wherein similar reference characters denote similar elements throughout the several views:

FIG. 3 is a fragmentary side view of the shank which abuts the tongue showing the slot formed in the lateral part of the shank and stepped in the leaning forward position, further showing a counterstop in said slot positioned against the stop;

FIG. 4 is an enlarged perspective view of the counterstop;

FIG. 5 is a fragmentary side view of the tongue showing the opening for supporting the counterstop;

FIG. 6 is a fragmentary side view of the tongue showing the counterstop assembled in the slot, and with the tongue in a non-deflecting position;

FIG. 7 is a perspective view of the counterstop oriented in the position in which the stop effect within the slot is cancelled;

FIG. 8 is a sectional view taken along line VIII—VIII of FIG. 6;

DETAILED DESCRIPTION OF THE PREFERRED EMBODIMENTS

Figure 1:
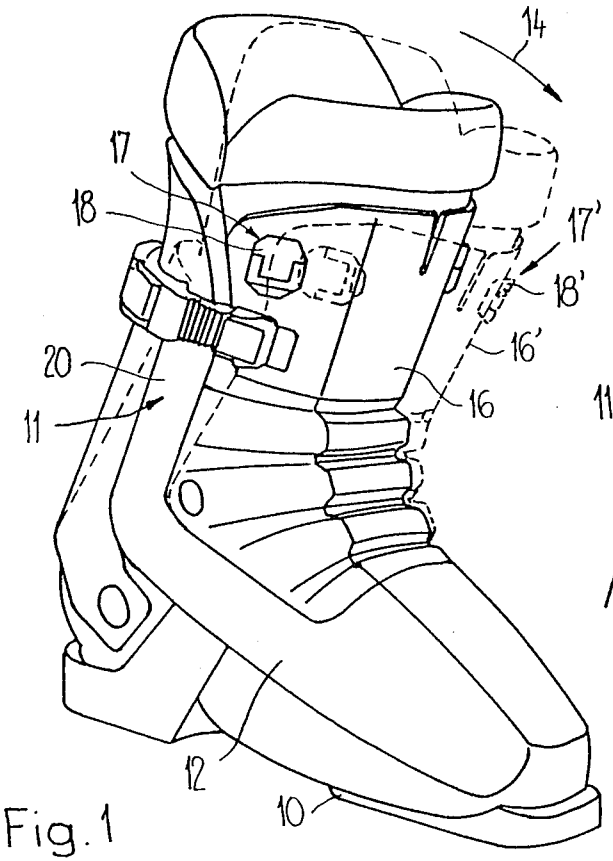
FIG. 1 is a perspective view of a ski boot showing a first embodiment of a device for limiting the deflection of the tongue and showing, in phantom line, the amount of tongue deflection relative to the shank.

Referring now in detail to the drawings, the ski boot shown in FIG. 1 has a boot shell 12 provided with a boot sole 10 and a shank 11, and a tongue 16 secured to such shell. The tongue 16 is deflectable relative to the shank 11 of the boot shell 12 when the skier leans forward, i.e., in the direction of arrow 14. A limiting device for limiting the path or distance that the tongue 16 can travel in the direction 14 is positioned on the tongue 16 and consists of two limiting arrangements 17 and 17' of the same type, which are arranged in inverse relation to each other, each having an actuating element 18, 18'.

Figure 2:
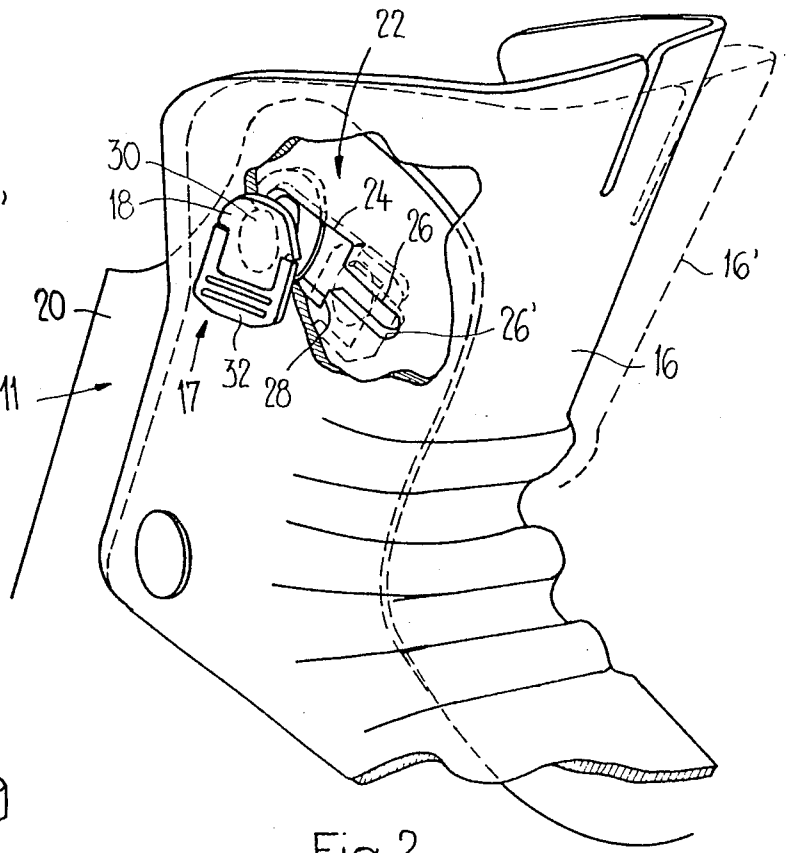
FIG. 2 is an enlarged, fragmentarily-illustrated perspective view of the tongue with a section broken away to show the construction of one of the limiting devices and showing, in phantom line, the extent of forward deflection of the tongue in such position.
Figure 16:
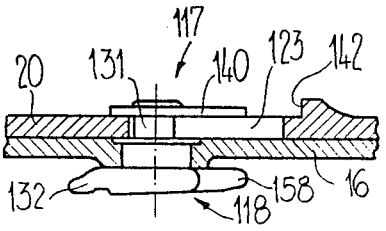
FIG. 16 is a cross-sectional view taken along line XVI—XVI of FIG. 15.

One of the limiting assemblies 17 is shown in association with tongue 16 in FIG. 2. A slot 22 is formed in the right-hand side 20 of the shank part 11 of the boot shell 12. The slot 22 has a wide zone 24 which connects in the leaning forward direction 14 to a narrow zone 26. A step 28 is formed at the point of transition between the two zones 24 and 26 and serves as a stop for a peg 30 which is supported within the opening 36 in the externally-disposed tongue 16. An actuating element 18 is torsionally rigidly connected with the peg 30 and has a toggle 32 that can be folded up to turn the actuating element 18. In FIGS. 1 and 2, 16' denotes the position of the tongue when the skier wearing the ski boot is in a leaning forward position and has his lower legs in an angular position relative to his feet.

FIG. 3 shows the slot 22 in the right hand side shank 20 with the peg 30 in the stop position. As shown in FIG. 4, peg 30 has a flattened head 34 which is positioned within slot 22 and is so dimensioned that its widest dimension is movable within the wide zone 24 of slot 22 without resistance up to the step 28 which functions as the stop means. If the peg 30, however, is turned by 90°, as shown in FIG. 7, the mobility of the peg 30 extends across the full length of the slot 22 because the flattened head 34, with its narrow dimension, is in alignment with and will move into the narrow zone 26 of the slot 22 when the tongue 16 moves forward.

Tongue 16 of the ski boot according to FIGS. 1 and 2 is deflectable in the leaning forward direction 14 relative to the shank 11, which is rigidly connected with the boot sole 10. Such deflectability is a function of the movement of the peg 30 within the slot 22, the extent of such movement depending on the selected position of the flattened head 34 of peg 30. In FIGS. 1 and 2, the dash lines show the deflectability 16' of the tongue part 16. If the peg 30 is turned into the position shown in FIG. 3, the path of deflection is limited by the stop 28.

FIG. 5 shows a circular cutout 36 in the tongue 16 which is in alignment with the slot 22 formed in the shank 11, such cutout serving as the bearing point for the peg 30.

In FIG. 6, the peg 30 is shown operatively connected with the slot 22 and with the tongue 16 in the non-deflected position, i.e., in the rest position. However, the flattened head 34 of peg 30, is shown aligned parallel with the lengthwise axis of the slot 22, so that on deflection of the tongue 16, when the skier leans forward, the flattened head 34 is movable past the stop 28 and into the narrow zone 26 of the slot 22. This permits the maximum deflection of the tongue 16.

As a further modification, the narrow zone 26 can be extended in such a way that its end 26' does not act as a second stop means. In this modification, the amount of deflectability of the tongue part 16 is limited only by the increasing resistance of the tongue itself. In this case, such limitation is dependent not upon a stop but rather on the elasticity of the tongue 16, and also upon the force applied by the skier in the leaning forward direction.

FIG. 7 shows the peg 30 in which the flattened part 34 is turned by 90° as compared to that shown in FIG. 4. The angle of rotation of the peg 30 can be limited by elements not shown, so that the two positions shown in FIGS. 4 and 7 are clearly indicated when an adjustment is made by hand.

FIG. 8 shows the axial fixation of the peg 30, which, on the outer side, is retained by the actuating element 18 adjacent the outer surface of the tongue 16 and which is torsionally rigidly connected to the peg 30, and is retained on the inner side of shank part 20 by a disk 38. As the tongue 16 is moved forward, the disk 38 slides along the inner surface of the shank 11 spanning slot 22. FIG. 8 shows, furthermore, that the limiting device requires very little space. If it is determined that the relatively thin disk 38 is troublesome in the inner space of the ski boot, such disk could be accommodated within a recess i the shank part 20 along each side of slot 22. The actuating element 18, which has to be adjusted by hand has a movable toggle-type lever 32 partially surrounding it which can be moved into a postion at a right angle to element 18. In such position, lever 32 permits the user to turn element 18. When not in use, the lever 32 can be folded into the plane of element 18, so that it will project from the ski boot less than, for example, the buckles serving for locking the boot.

Figure 9:
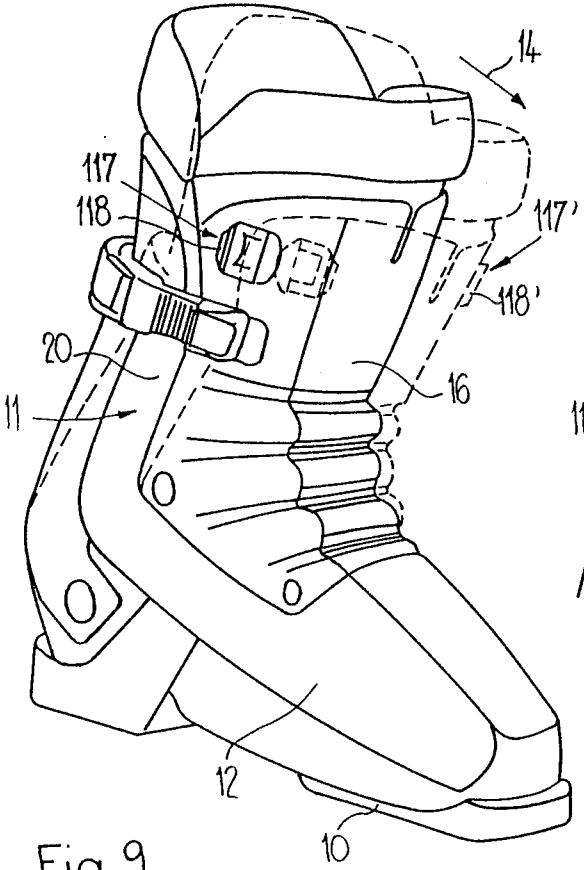
FIG. 9 is a perspective view of a ski boot similar to that of FIG. 1, but showing a second embodiment of a device for limiting the deflection of the tongue according to the invention.

FIG. 9 illustrates a second embodiment of the invention. Here too, the ski boot has a shell 12 provided with a sole 10 and a shank 11. A tongue 16 is secured on the shell 12 and is deflectable relative to the shank 11, when the skier leans forward, in the direction 14. In this embodiment, the limiting device consists of a right-hand limiting arrangement 117 and a left-hand limiting arrangement 117' operatively connected to the tongue 16 which serve to limit the distance which the tongue 16 can travel in the direction 14 when the skier leans forward. The two arrangements 117 and 117' are disposed mirror-inverted relative to each other and have actuating elements 118 and 118', respectively.

Figure 10:
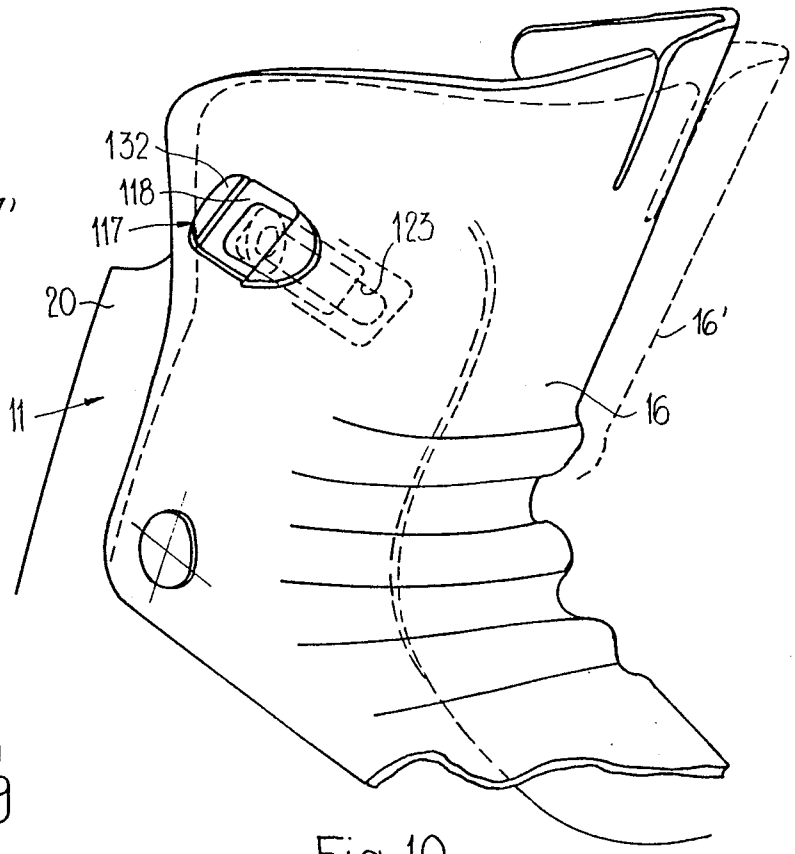
FIG. 10 is an enlarged perspective view of the tongue showing, in dash lines, the limiting device formed in the shank which is positioned behind the tongue part.

FIG. 10 shows an enlarged view of the tongue 16 with the right-hand arrangement 117. The actuating element 118 has a toggle 132 that can be folded up. A slot 123, extending in the leaning forward position 14, is arranged in the right-hand part 20 of the boot shell 12 according to FIG. 9. Reference numeral 16' denotes in FIG. 10 the leaning forward position, in which the skier wearing the ski boot has shifted his lower legs into an angular position relative to the feet in the forward direction.

Figure 11:
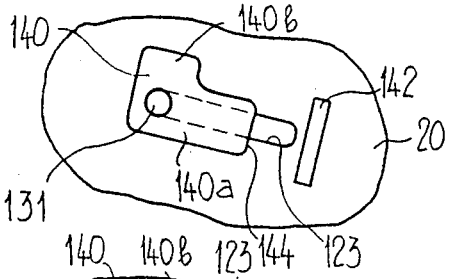
FIGS. 11 to 13 are side views of the limiting device, as viewed from inside the boot, sequentially illustrating the minimum, medium and maximum deflection of the tongue, respectively.
Figure 12:
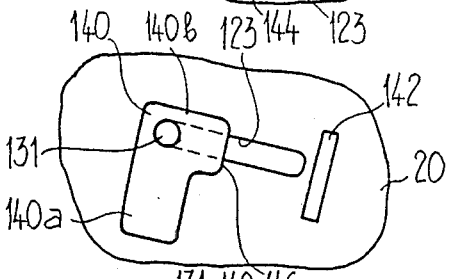
Figure 13:
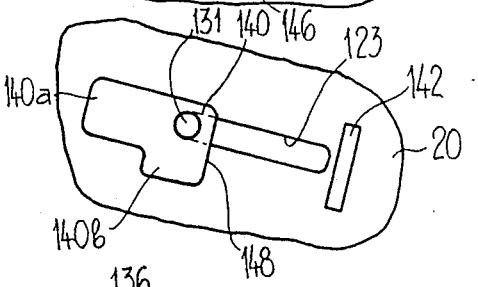
Figure 14:
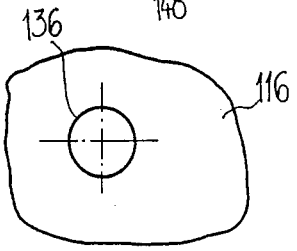
FIG. 14 is a fragmentary side view of the tongue showing the opening therein for supporting the limiting device.

FIGS. 11 to 13 show the parts of the modified limiting device on the left-hand side of shell 12 and showing the inner side of part 20 of shank 11. An L-shaped limiting element 140 is positioned adjacent the inner surface of shank part 20 and is connected to the actuating element 118 by means of a peg 131. Peg 131 is supported within an opening 136 in tongue 16 and extends through slot 123 formed in the shank 20 and is secured to the limiting element 140. When the skier leans forward, peg 131 moves within the slot 123 as tongue 16 moves forward.

Limiting element 140 has a general L-shaped configuration having a short leg 140*b* and a longer leg 140*a*. The counterstops 144, 146 and 148 are formed by the plane surfaces which are disposed with different spacing from the axis of rotation of peg 131. A stop 142 is formed to extend from the inner surface of shank part 20 is in axial alignment with the slot 123, and engages the counterstop upon movement of limiting element 140.

FIG. 16 shows the axial fixation of peg 131, in which actuating means 118 is secured to its outer end and the limiting element 140 is secured to its inner end. The limiting element 140 slides along the surface of shank 11 on either side of slot 123 in response to the movement of peg 131 within the slot 123. Stop 142 which is in alignment with slot 123 will engage the selected counterstop position on said limiting element in response to the deflection of tongue 16.

The amount of deflection of the tongue 16 can be limited to varying distances by providing different angular positions of the limiting element 140 which cooperates with stop 142. FIG. 11 shows the limiting element 140 set for minimum limitation, in FIG. 12 it is set for medium limitation, and in FIG. 13 it is set for maximum limitation.

In a variation of this described embodiment, it is possible to obtain a larger number of stops for limiting the skier's leaning forward position by designing the limiting element 140 in other than an "L" configuration to provide more counterstops. Furthermore, a limiting element conceivably could be designed in such a way that the counterstops are formed by one single, spirally extending surface. Such a design would permit stepless adjustment of the limiting device, and, in turn, would provide many positions of deflection of the tongue.

Figure 15:
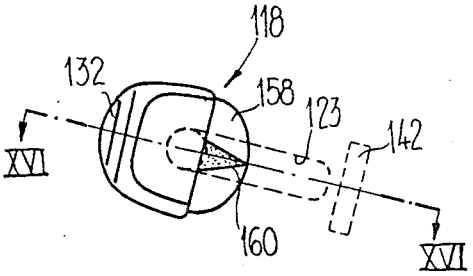
FIG. 15 is a fragmentary side view of an actuating element of the limiting device.

The actuating device 118 shown in FIG. 15 has a rotary knob 158, on which the toggle 132 is fastened in such a way that it can be raised or swung out. A pointer 160 on the rotary knob 158 serves for indicating the selection of the particular counterstop on the limiting element 140.

FIG. 16 is a sectional view taken along the longitudinal axis of slot 123, which basically shows the relationship of all elements of the one limiting arrangement 117. Although the limiting element 140 and the stop 142 are arranged in this embodiment on the inside of the boot, it is possible to modify the device in such a manner that such elements are disposed between the shank part 11 and the tongue part 16, leaving the inside surface of the boot free from protruding parts.

Figure 17:
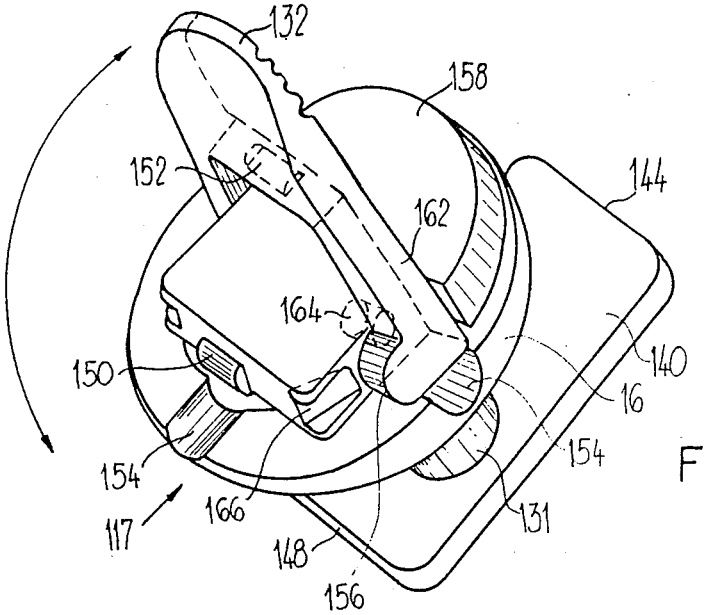
FIGS. 17 and 18 are perspective views of the actuating device showing the toggle in the folded-up and folded-back positions, respectively.

FIG. 17 shows the basic parts of the limiting element 140 with toggle 132 in a raised position. This figure clearly shows that the toggle 132 is a U-shaped part, which is supported on the rotary knob 158 by two legs 162 that it can be moved to the position shown in FIG. 17 or to the position shown in FIG. 18. So as to avoid any unintentional outward swivel motion of the toggle 132, stop elements 150 and 152 are provided, which lock the toggle 132 in its folded-in position. Such stop elements are comprised of an arresting nose 150 and a matching recess 184 on the toggle 132. For its support in the rotary knob 158, the toggle 132 has the journal pins 164 on its legs 162, which pins engage matching recesses in the rotary knob 158. So as to facilitate the mounting of the toggle 132 on the rotary knob 158, the latter has the slideways 166 serving as ramps for the journal pins 164.

Figure 18:
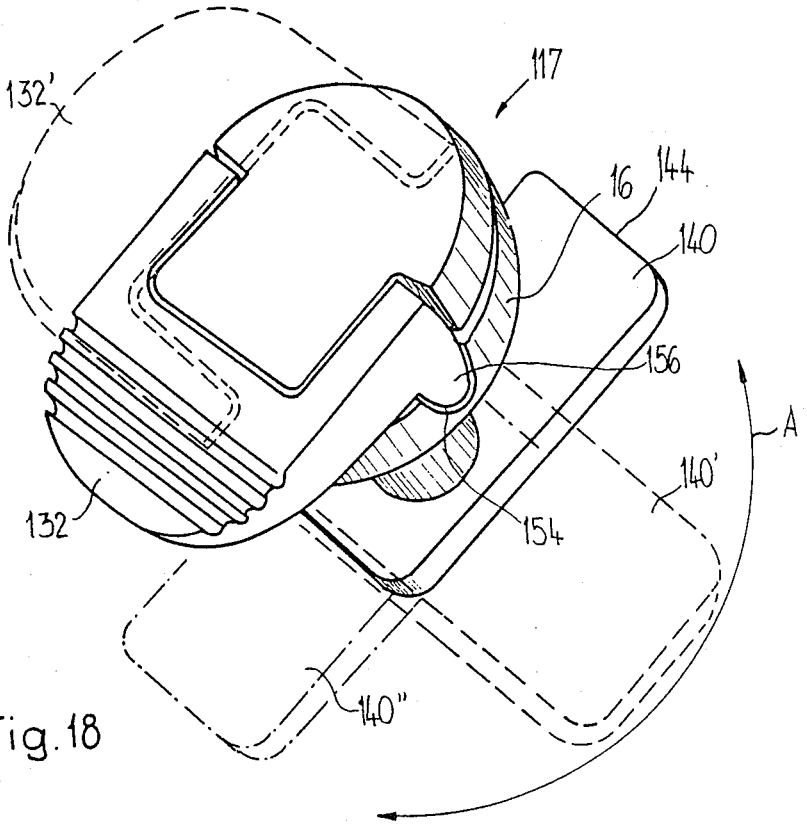

When the toggle 132 is in the folded-in position as shown in FIG. 18, cams 156 formed on legs 162 engage recesses 154 formed in the tongue part 16. The recesses 154 and the cams 156 serve as safety elements securing the toggle 132 against rotation when in its folded-in position and assuring that the pre-set position of the limiting device 140 cannot move.

As shown in FIG. 18, the position 132' of the toggle 132 shows the adjustment possibility for setting or adjusting the limiting element 140 in the direction of arrow A, depending on the permissible degree of deflection of tongue 16 desired. Possible positions of the limiting element 140 are shown by dashed and dash-dotted lines and denoted by the reference numerals 140' and 140'', respectively.

In both disclosed embodiments, the peg 30 and 131 is supported in the tongue 16, whereas the slot 22 or 123, respectively, is arranged in the shank part 11, such peg 30 or 131 being displaceable within such slot in order to permit the relative motion between the tongue 16 and the shank 11. However, this arrangement may be reversed depending on the design of the ski boot, that is, the peg may be supported in the shank and a slot may be arranged in the tongue.

Instead of having the limiting element 140 of the second embodiment rotatable with peg 131, such element may be formed with the limiting element having stepped counterstops movable lengthwise of the slot. With such a variation, it is conceivable to make provision for a slot in the outer part of the boot, for example, in the tongue part, with such a limiting element being linearly displaceable within such a slot. The number of steps for the adjustment of different limitations of the path of leaning forward may be selected as desired to satisfy the requirements in this regard.

It is to be understood that the foregoing general and detailed descriptions are explanatory of the present invention and are not to be interpreted as restrictive of the scope of the following claims.

What is claimed is:

1. A ski boot having a shell comprising:

a sole;

a shank coupled to said sole;

a tongue deflectable relative to said shank in a leaning forward direction under stress in the lengthwise direction of the boot; and means for limiting the distance to be travelled by said tongue, said limiting means operatively connecting said tongue and shank, and said limiting means having at least one stop.

2. A ski boot according to claim 1, wherein said limiting means comprises two identical devices for limiting the leaning forward position of said tongue, said limiting devices being positioned opposing each other on opposite sides of the boot relative to the lengthwise plane of the boot.

3. A ski boot according to claim 1, wherein each limiting means has a counterstop, wherein one of said tongue and said shank has said counterstop adjustably supported therein and the other one of said tongue and said shank has said stop formed therein, such counterstop being reversible between a first position and a second position in the former of which it cooperates with and engages said stop.

4. A ski boot according to claim 3, wherein the counterstop is formed by a flattened head on a peg, said peg being rotatably supported in the tongue, said flattened head engaging a slot formed in a lateral portion of the shank and extending in the leaning forward direction of said tongue, and said slot containing said stop.

5. A ski boot according to claim 4, wherein said slot has a wide zone and a narrow zone wherein said stop being formed by the separation of said zones, said narrow zone following said wide zone in the leaning forward direction, the width of said narrow zone being dimensioned in a way such that the flattened head of said peg fits into said narrow zone only when said counterstop is in its second position.

6. A ski boot according to claim 4, wherein the angle of rotation of the peg is limited to 90° .

7. A ski boot according to claim 3, wherein the actuating element comprises a toggle, said toggle being torsionally rigidly connected with the peg.

8. A ski boot according to claim 5, wherein the narrow zone of said slot ends in a second stop for engaging the flattened head of the peg.

9. A ski boot according to claim 1, wherein each limiting means has a limiting element providing at least two counterstops for providing for different distances of travel of said tongue in the leaning forward direction, such limiting element being reversible between at least two positions, so that in a first position the first counterstop cooperates with said stop, and in a second position the second counterstop cooperates with said stop.

10. A ski boot according to claim 9, wherein the limiting element is connected to an actuating element and is adjustably secured on the tongue, and said stop is rigidly arranged on the shank of the boot shell.

11. A ski boot according to claim 9, wherein a peg is rotatably retained in said tongue and is operatively positioned in a slot formed in said shank, said limiting element secured to and rotatable with said peg.

12. A ski boot according to claim 11, wherein said counterstops are formed by plane surfaces on said limiting element, said plane surfaces being disposed with different spacings from the rotary axis of said peg.

13. A ski boot according to claim 12, wherein said counterstops are formed by a single, spirally extending surface.

14. A ski boot according to claim 9, wherein said limiting element and said stop is arranged on the inside of the boot.

15. A ski boot according to claim 9, wherein said limiting element and said stop is positioned between the shank and the tongue.

16. A ski boot according to claim 9, wherein said actuating element connected to the limiting means is positioned on the outer side of the boot shell and said actuating element has a toggle capable of movement between a folded open and folded back position.

17. A ski boot according to claim 16, additionally including locking means for releasably securing said toggle in its folded-back position.

18. A ski boot according to claim 17, wherein said toggle has cams formed thereon and said tongue has recesses formed therein for releasably receiving said cams, said cams and recesses thereby cooperating with one another to secure said toggle against rotation.

* * * * *